US009012814B2

(12) United States Patent
Park et al.

(10) Patent No.: US 9,012,814 B2
(45) Date of Patent: Apr. 21, 2015

(54) COOKING APPLIANCE, CONTROLLING SYSTEM FOR COOKING DEVICE AND CONTROLLING METHOD FOR COOKING DEVICE

(75) Inventors: Jun Hyun Park, Changwon (KR); Soo Cheol Yi, Changwon (KR)

(73) Assignee: LG Electronics Inc., Seoul (KR)

( * ) Notice: Subject to any disclaimer, the term of this patent is extended or adjusted under 35 U.S.C. 154(b) by 1282 days.

(21) Appl. No.: 12/522,812

(22) PCT Filed: Nov. 15, 2007

(86) PCT No.: PCT/KR2007/005754

§ 371 (c)(1),
(2), (4) Date: Dec. 30, 2009

(87) PCT Pub. No.: WO2008/084917

PCT Pub. Date: Jul. 17, 2008

(65) Prior Publication Data

US 2010/0140248 A1 Jun. 10, 2010

(30) Foreign Application Priority Data

Jan. 11, 2007 (KR) ..... 10-2007-0003299
Jan. 17, 2007 (KR) ..... 10-2007-0005316
Jan. 17, 2007 (KR) ..... 10-2007-0005317
Jan. 25, 2007 (KR) ..... 10-2007-0007805

(51) Int. Cl.
*A21B 1/22* (2006.01)
*H05B 1/02* (2006.01)
*F24C 7/08* (2006.01)

(52) U.S. Cl.
CPC ..... *F24C 7/087* (2013.01)

(58) Field of Classification Search
CPC ..... F24C 7/087
USPC ..... 219/391, 490; 99/325
See application file for complete search history.

(56) References Cited

U.S. PATENT DOCUMENTS 4,551,618 A 11/1985 Payne
5,317,134 A 5/1994 Edamura
(Continued)

FOREIGN PATENT DOCUMENTS

CN 1116290 A 2/1996
CN 1434251 A 8/2003
(Continued)

OTHER PUBLICATIONS

Machine translation of JP2006145146, Jun. 2006, Japan, Ishiwatari et al.*

*Primary Examiner* — Jianying Atkisson
(74) *Attorney, Agent, or Firm* — Birch, Stewart, Kolasch & Birch, LLP

(57) ABSTRACT

Provided are a cooking appliance, and a system and method for controlling a cooking appliance. The system includes a RF tag and a cooking appliance. The RF tag stores food information about foods as integrants of a dish and the cooking appliance having a RF reader reads the food information stored in the RF tag. The cooking appliance includes a memory, a cooking appliance controller, and a display unit. The memory stores dish information about dishes that can be cooked using the food information. The cooking appliance controller reads dish information from the memory, and the display unit displays at least one of the dish information to a user.

17 Claims, 8 Drawing Sheets

(56) References Cited

U.S. PATENT DOCUMENTS

| | | | | |
|---|---|---|---|---|
| 7,092,988 | B1 | 8/2006 | Bogatin et al. | |
| 7,919,736 | B2 * | 4/2011 | Ikeda et al. | 219/714 |
| 2002/0059175 | A1 | 5/2002 | Nakano | |
| 2002/0157411 | A1 | 10/2002 | Ishikawa et al. | |
| 2005/0011886 | A1 | 1/2005 | Kim | |
| 2006/0178947 | A1 * | 8/2006 | Zsigmond et al. | 705/26 |
| 2006/0254432 | A1 * | 11/2006 | McLemore | 99/448 |

FOREIGN PATENT DOCUMENTS

| | | | | | |
|---|---|---|---|---|---|
| CN | 1514672 | A | | 7/2004 | |
| JP | 2001-317741 | A | | 11/2001 | |
| JP | 2001317741 | A | * | 11/2001 | F24C 7/02 |
| JP | 2003-307313 | A | | 10/2003 | |
| JP | 2006-145146 | A | | 6/2006 | |
| KR | 10-2001-0069113 | A | | 7/2001 | |
| KR | 10-2002-0015628 | A | | 2/2002 | |
| KR | 10-2003-0063082 | A | | 7/2003 | |
| KR | 10-2004-0047630 | A | | 6/2004 | |
| KR | 10-2005-0009540 | A | | 1/2005 | |
| KR | 10-2005-0028097 | A | | 3/2005 | |
| KR | 10-2005-0080409 | A | | 8/2005 | |
| KR | 10-2006-0013980 | A | | 2/2006 | |
| KR | 10-2006-0065981 | A | | 6/2006 | |
| RU | 69 653 | U1 | | 12/2007 | |

* cited by examiner

Fig. 1
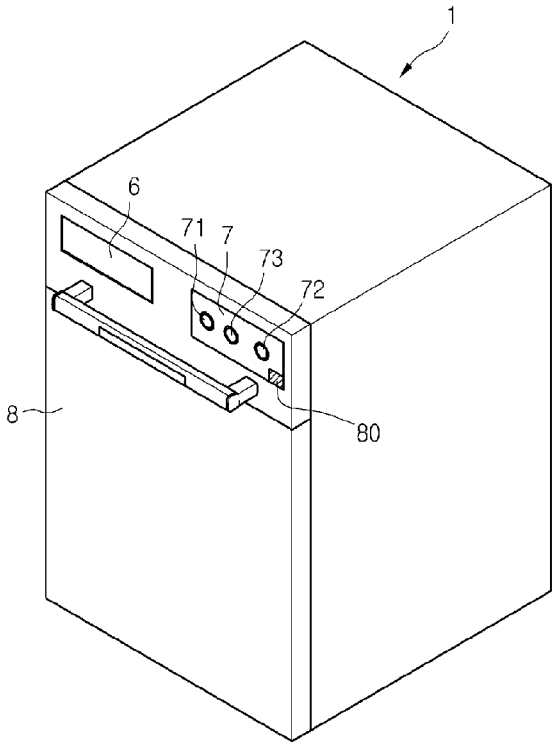
Fig. 2
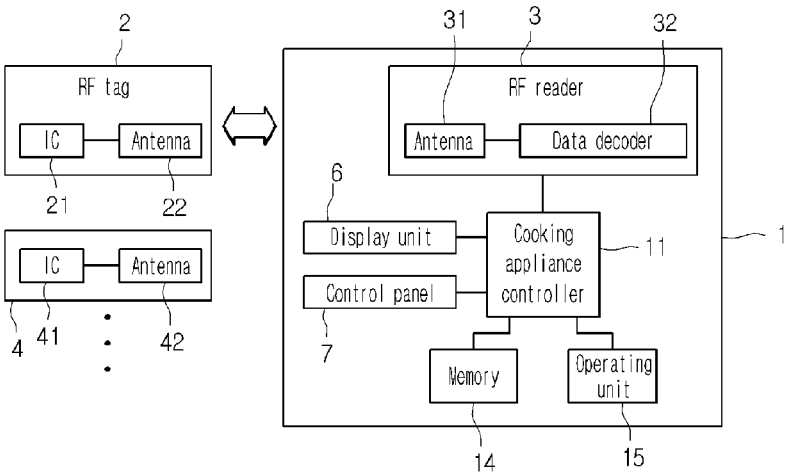
Fig. 3
| Address | Field name |
|---|---|
| 0 | Start code |
| 1 | Authentication code |
| 2 | Unique information of food |
| 3 | Error code |
| 4 | End code |

| Address | Field Name |
|---|---|
| 0 | Start code |
| 1 | Authentication code |
| 2 | Food hierarchical information |
| 3 | Network address information |
| 4 | Unique ID of food |
| 5 | Error code |
| 6 | End code |

COOKING APPLIANCE, CONTROLLING SYSTEM FOR COOKING DEVICE AND CONTROLLING METHOD FOR COOKING DEVICE

TECHNICAL FIELD

The present disclosure relates to a cooking appliance, and a system and method for controlling a cooking appliance.

BACKGROUND ART

In general, a representative cooling appliance is an oven or a cooktop.

The oven is a chamber of an enclosed compartment for heating, baking, or roasting food. The cooktop is a heating element for heating a cooking ware which puts on the cooktop with a predetermined food contained in order to indirectly heating the food.

Meanwhile, a RF tag is generally attached at a surface of a food or a package paper of a food in order to conveniently identify the food. The RF tag is a part of a RF tag reading system.

The RF tag reading system includes a RF tag and a RF reader. When a RF reader requests the RF tag to transmit tag data, the RF tag transmits the tag data to the RF reader in RF frequency.

DISCLOSURE OF INVENTION

Technical Problem

Embodiments provide a system and method for controlling a cooking appliance, which enable a user to conveniently control a cooking appliance in various ways using a RF tag reading system, thereby using a cooking appliance safely and conveniently.

Embodiments also provide a system and method for accurately controlling a cooking appliance and further properly cooking a food with optimal condition.

Technical Solution

In one embodiment, a system for controlling a cooking appliance includes a RF tag and a cooking appliance. The RF tag stores food information about foods as integrants of a dish and the cooking appliance having a RF reader reads the food information stored in the RF tag. The cooking appliance includes a memory, a cooking appliance controller, and a display unit. The memory stores dish information about dishes that can be cooked using the food information. The cooking appliance controller reads dish information from the memory, and the display unit displays at least one of the dish information to a user.

In another embodiment, a method for controlling a cooking appliance includes reading at least one food information about a food as ingredient of a predetermined dish from a RF (radio frequency) tag, generating dish information about dishes that can be cooked using foods in the read food information with reference to the read food information, and displaying the dish information on a cooking appliance.

In further another embodiment, a method for controlling a cooking appliance includes radiating energy by applying power to a RF (radio frequency) reader, and performing a working mode of a cooking appliance if the RF reader senses that the RF tag is present in a heating area of the cooking appliance.

In still further another embodiment, a cooking appliance includes an oven cavity, a door, at least one of heaters, a RF reader, and a controller. The door selectively opens the oven cavity, and the heaters heat the inside of the oven cavity. The RF reader is disposed at a predetermined location to perform radio frequency communication in an inside of the oven cavity, and the controller controls an oven. The controller performs a warning mode if the RF reader senses that a RF tag is present in the inside of the oven cavity.

In yet another embodiment, a method for controlling a cooking appliance includes reading food information from a RF (radio frequency) tag using a RF reader disposed inside a cooking appliance, transmitting current state information of a food processed using at least the food information from the cooking appliance to a server, and transmitting optimal control data of the cooking appliance to cook the food from the server to the cooking appliance.

The details of one or more embodiments are set forth in the accompanying drawings and the description below. Other features will be apparent from the description and drawings, and from the claims.

Advantageous Effects

A system and method for controlling a cooking appliance according to this document enable a user to utilize a cooking appliance in various ways using a RF tag reading system. Also, the controlling system and method controls the cooking appliance to accurately cook foods according to a predetermined cooking method and to provide the natural flavor of the foods to a user. Furthermore the controlling system and method controls the cooking appliance to perform the optimal cooking operation according to the specification of the cooking appliance. Moreover, the controlling system and method prevent foods from being damaged or on fire, which may be caused by the wrongful use of a RF tag reading system. The controlling system and method may lead the popularization of the RF tag reading system, and may extend a service life of a cooking appliance by correcting a service life problem caused by the superannuation of a cooking appliance.

BRIEF DESCRIPTION OF THE DRAWINGS

FIG. 1 is a perspective view of an over according to the first embodiment.

FIG. 2 is a block diagram illustrating a cooking appliance according to the first embodiment.

FIG. 3 is an information table stored in a RF tag according to the first embodiment.

BEST MODE FOR CARRYING OUT THE INVENTION

Figure 4:
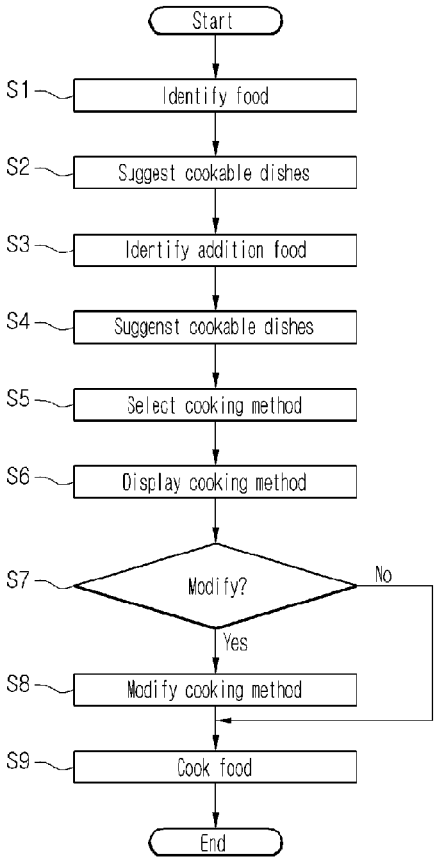
FIG. 4 is a flowchart of a method for controlling a cooking appliance according to the first embodiment.

Reference will now be made in detail to the embodiments of the present disclosure, examples of which are illustrated in the accompanying drawings.

<First Exemplary Embodiment>

FIG. 1 is a perspective view of an oven according to the first exemplary embodiment.

Referring to FIG. 1, the oven 1 according to the present embodiment includes a door 8 disposed at a front side thereof for opening and closing a cavity, a display unit 6 provided with a control panel that is disposed at an upper part of the door 8 for displaying the operating states of the oven, and an control panel 7 for controlling the operations of the oven.

The control panel 7 includes a plurality of buttons. In more detail, the control panel 7 includes a suggestion button 71 for controlling a cooking appliance to identify foods and suggest a recipe based on the identified foods, a cooking method button 72 for controlling the cooking appliance to suggest a detailed cooking method according to the suggested recipe, and an modification button 73 for controlling the cooking appliance to the suggested cooking method according to the taste of a user. The control panel 7 is not limited to provide only the buttons that were described above. The control panel 7 may provide information for controlling the operations of the cooking appliance.

Hereinafter, the operations of the buttons will be described.

The suggestion button 71 is a button to enable a cooking appliance to prepare a set of algorithms to identify information of a food when a user puts a RF tag attached at a packing sheet of a food or a food closer to the cooking appliance. After identifying the food, recipes of dishes that can be cooked using the identified foods may be suggested based on the identifying result.

After suggesting the recipes of the dishes that can be cooked using the identified food by the suggestion button 71, a user selects one of the suggested recipes. The cooking method button 72 is a button for controlling a cooking appliance to suggest the cooking method based on the suggested recipe.

The modification button is to modify the suggested cooking method according to the taste of a user. For example, if a user wants to get a food well done, the modification button enables a user to change the time of heating the food. When a user activates the cooking method button 72, the display unit of the cooking appliance displays a cursor on a cooking method window displayed on the display unit and a user changes the related numbers by controlling the location of the cursor. In order to operate the display unit in such a way, a touch pad display unit may be used.

Meanwhile, the oven 1 includes a RF reader 3 shown in FIG. 2. Although the RF reader 3 may be disposed at any locations of the oven 1, it is preferable that the RF reader 3 is provided at one side of the control panel 7. That is, the RF reader is disposed at one side of the control panel 7 and an indicator 80 is disposed at the front side of the RF reader. The indicator 80 informs a user that a RF reader is disposed thereunder. That is, the indicator 80 guides a user to conveniently scan the RF tag through the RF reader that is disposed under the indicator 80. Therefore, a user may conveniently scan the RF tag through the RF reader. It is preferable to dispose the RF reader at a position of the oven, where the heat from a heating source does not reach because the oven includes the heating source that generates high temperature heat. It is also preferable to dispose the RF reader at a position of the oven, where is not far away from other related electronic parts for reducing the length of wires connected between the RF reader and the other related electronic parts. In consideration such factors, the RF reader may be preferably disposed at the control panel 7.

However, the RF reader is not limited to be disposed at the control panel 7. The RF reader may be disposed at various positions of the oven. Hereinafter, preferable positions of the oven for the RF reader will be described.

In case of a card type RF reader, the RF reader can be integrally manufactured with one of parts of the oven, which are formed through injection molding. For example, the RF reader may be integrally manufactured with a handle of a door or a door of an oven. Since the handle and the door of the oven are disposed at the exterior of the oven, the handle and the door are quickly cooled down by the air. It is a main reason of disposing the RF reader at the handle or the door of the oven. In case of an electronic oven, it is preferable to dispose the RF reader in a door and a handle thereof because the door and the handle thereof are manufactured through the injection molding.

Hereinafter, a system and method for controlling a cooling appliance according to the first embodiment will be described with reference to a block diagram of a cooking appliance shown in FIG. 2.

Referring to FIG. 2, the cooking appliance 1 includes a cooking appliance controller 11 for controlling overall operations of the cooking appliance, a control panel 7 for enabling a user to control the operations of the cooking appliance, a display unit 6 for displaying the operating states of the cooking appliance, a memory 14 for storing the operating information of the cooking appliance, and an operating unit 15 having a plurality of parts with a heating source for operating and heating the cooking appliance.

The cooking appliance 1 further includes a RF reader 3 for sensing RF tags 2 and 4. The RF reader 3 includes an antenna 31 and a data decoder for decoding radio information received through the antenna 31 to readable information.

The RF tags 2 and 4 store various information. FIG. 3 shows the information stored in the RF tags 2 and 4. As shown in FIG. 3, the information stored in the RF tags 2 and 4 includes a start code for indicating the start of data and an end code for indicating the end of data. The information also includes an authentication code for authenticating an authentication code of the RF reader 3 and an error code for determining whether or not an error is generated when the data is transmitted. Here, the RF tags 2 and 4 may be attached at a package paper of a food.

The above mentioned fields are essential codes to operate a RF tag reading system. The fields may vary according to the detail specifications of the RF tag reading system.

The RF tag may further include unique information about a corresponding food at the second address of the information stored in the RF tag. A cooking appliance obtains the unique information about the food through the RF tag reading system and controls predetermined operations based on the reading result.

Hereinafter, the operations of a system for controlling a cooking appliance according to the first embodiment will be described. At first, when a user activates the suggestion button 71, a RF tag reading system starts to operate. When a user puts the first RF tag 2 closer to the cooking appliance, the RF reader 3 receives information recorded in the first RF tag 2 and the data decoder 32 reads the information stored in the first RF tag 2. That is, the data decoder 32 reads unique information about a food among information stored in the first RF tag 2.

After reading the unique information of the food, the read information is transferred to the cooking appliance controller 11. Then, the cooking controller 11 obtains the type, the volume, and the processing state of the corresponding food by analyzing the received unique food information and determines dishes that can be cooked based on the identified food. The memory 14 stores information about the dishes. The information recorded in the memory 14 may be read in response to the control of the cooking appliance controller 11 and displayed on the display unit 6. For example, if the identified food is 100 gram of kneaded flour, information about dishes that can be cooked using the identified food, such as pizza or a fried dish, may be displayed.

Then, a user puts the second RF tag 4 closer to the cooking appliance. Since the procedure of identifying the second RF tag 4 is identical to that of the first RF tag 3, the detailed description thereof is omitted. For example, if the second RF tag 4 is for 200 grams of sliced cheese, the cooking appliance suggests dishes that can be cooked using the second identified food, cheese, and the first identified food, the kneaded flour. That is, the suggested dish may be a pizza.

If a user selects a pizza from dishes displayed on the display unit 6 and activates the cooking method button 72, the cooking appliance displays a cooking method based on the recipe of the selected dish, that is, the pizza. After a user carefully reads the displayed cooking method, the user may modify the displayed cooing method using the modification button 73.

Then, a user prepares the identified foods based on the suggested recipe and puts the processed foods into the cooking appliance. Then, the user activates the operating button and the cooking appliance heats the processed foods according to the modified cooking method.

As described above, the cooking appliance control system enables a user to conveniently cook foods and to easily control a cooking appliance although the user does not know how to cook foods.

Hereinafter, a method for controlling a cooking appliance according to the first embodiment will be described.

FIG. 4 is a flowchart of a method for controlling a cooking appliance according to the first embodiment embodiment.

Referring to FIG. 4, a user activates the suggestion button 71 to control a cooking appliance to operate in a RF tag reading mode and a user puts a RF tag of a predetermined food closer to the indicator 80 at step S1. Then, the cooking appliance 1 suggests dishes that can be cooked using the identified foods in operation S2 after obtaining unique information of the identified foods. Here, the procedures of obtaining the unique information of the identified foods and suggesting the dishes based on the obtained information are identical the above described procedures of the system for controlling a cooking appliance.

If a user finds a desired dish from the suggested dishes after scanning one semi-finished food, the user may terminate the procedure of identifying foods using RF tags. Since various foods are needed to cook a dish, a user generally scans at least two of semi-finished foods using the RF tags thereof.

In this case, the cooking appliance identifies the second food using the RF tag thereof in operation S3 and suggests dishes that can be cooked using the second identified food in operation S4. These operations are identical to the operations of identifying the first food and suggesting the dished based on the first identified food. After identifying the second food, the cooking appliance suggests dishes that can be cooked using not only the second identified food but also the first identified food.

The operations for identifying foods and suggesting dishes are repeatedly performed until a cooking appliance suggests a dish that a user wants.

After the cooking appliance displays a desired dish on the display unit, the user activates the cooking method button 72 and confirms a cooking method for the selected dish in operation S5. Then, the cooking appliance 1 displays a cooking method for the selected dish on the display unit 6 in operation S6. For example, if the cooking appliance 1 identifies kneaded flour and sliced cheese, the cooking appliance 1 may display a cooking method for a pizza.

After displaying a cooking method, it is determined whether a user wants to modify the cooking method or not in operation S7. If the user wants to modify, the user modifies the cooking method by activating the modification button 73 in operation S8.

Then, the cooking appliance performs operations to cook the food according to the suggested cooking method or the modified cooking method in operation S9.

As described above, a user can be suggested with various dishes that can be cooked using foods that a user bought. Therefore, a user can cook various dishes and enjoy the dishes conveniently.

Hereafter, other implementations of the system and method for controlling a cooking appliance according to the first embodiment will be described.

In another implementation, the suggestion button 71, the cooking method button 72, and the modification button 73 are integrated into one button. And, different operations are performed according to the number of clicking the button. In a view of user convenience, it is preferable to provide a plurality of buttons in order to assign a unique operation to each button.

In another implementation, instead of providing additional buttons at the control panel, a touch screen type display unit may be provided to enable a user to select one of menu or to activate one of operations by touching a related icon displayed on the display unit.

Also, a manual food preparing procedure for manually preparing foods that require a user to manually process may be performed between the operation S6 of displaying the cooking method and the operation S8 of modifying the cooking method. Furthermore, the manual food preparing procedure may be performed between the operation S6 for displaying the cooking method and the operation S9 for cooking the foods.

<Second Exemplary Embodiment>

In the first exemplary embodiment, a RF reader disposed in a cooking appliance is used to control the cooking appliance in various ways, thereby improving the convenience of a user. However, it is assumed that a RF tag is attached at a package paper of a food in the first exemplary embodiment. Although the RF tag may make a user convenient, the RF tag may cause a problem too. For example, if a food puts into an oven with a RF tag attached, a substrate and metallic elements of the RF tag are burned. Then, the foods may be damaged and a user cannot eat the damaged foods.

In order to overcome such a problem, the second exemplary embodiment is introduced. That is, it is automatically determined whether a RF tag is in the oven or not.

Figure 5:
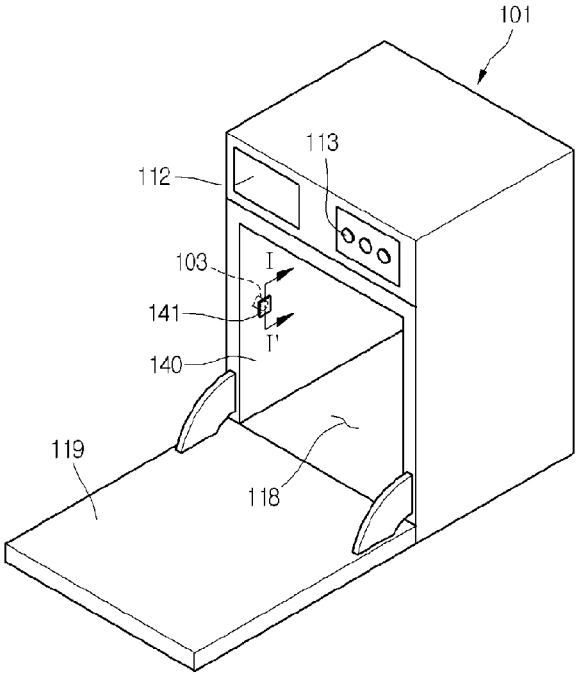
FIG. 5 is a perspective view of a cooking appliance according to the second embodiment.

FIG. 5 is a perspective view of a cooking appliance according to the second embodiment.

Referring to FIG. 5, the cooking appliance 101 includes a cavity 118 for receiving foods, a door 119 for selectively opening and closing the cavity 118, a display unit 112 disposed at one side of the cooking appliance for displaying the operating states of the cooking appliance, and a control panel 113 for enabling a user to control the cooking appliance. The cooking appliance 101 includes a RF reader 103 disposed at one side of the cavity for sensing a RF tag when the RF tag enters the cavity 118. A plurality of heaters (not shown) are disposed at a wall 140 of the cavity. The heaters may include a magnetron for reflecting electromagnetic waves, a radiation heater for radiating a radiant energy, and a convection heater.

The RF reader 103 detects whether a RF tag enters in the cavity or not. That is, the RF reader 103 radiates energy in the cavity and senses the RF tag 102 shown in FIG. 7. When the RF reader 103 detects that the RF tag is in the cavity 118, the cooking appliance may be turned off, the operation buttons of the control panel may be inactivated, and a message that informs a user of the present of the RF tag is displayed on the display unit.

In order to accurately detect whether the RF tag 102 is in the cavity 118 or not by the RF reader 103, the RF reader 103 propagates a radiant energy of an antenna to the inside of the cavity. Furthermore, a predetermined shield structure may be provided not to transfer the internal heat of the cavity to the RF reader 103.

Figure 6:
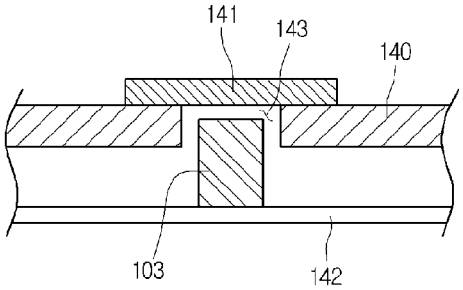
FIG. 6 is a cross section view of FIG. 5 taken along the line I-I'.

A structure that satisfies the above mentioned necessities is shown in FIG. 6.

FIG. 6 is a cross sectional view of FIG. 5 taken along the line I-I'. Referring to FIG. 6, the RF reader 103 is fixed at fixing parts such as a substrate 142, and an opening 143 is formed at the cavity wall 140 to propagate the radiant energy of the RF reader 103 inside the cavity 118. If the opening 143 is not provided, the RF reading system does not smoothly operate because the radio frequency of the RF reading system is blocked by the wall 140 of the cavity. That is, a predetermined part of the RF reader 103 faces the opening 143 of the wall 140. Not to transfer the inside heat of the cavity to the RF reader 103 through the opening 143, a heat shielding layer 141 is formed at a predetermined location of the wall in line to the opening 143. The heat shielding layer 141 is not a conductive in order to transfer radio frequency through the heat shielding layer 141.

According to the described structure, the internal heat of the cavity does not influence the RF reader 103, the radiant energy of the RF reader 103 is smoothly transferred to the inside of the cavity, and it is accurately determined whether the RF tag is inserted into the cavity or not.

Figure 7:
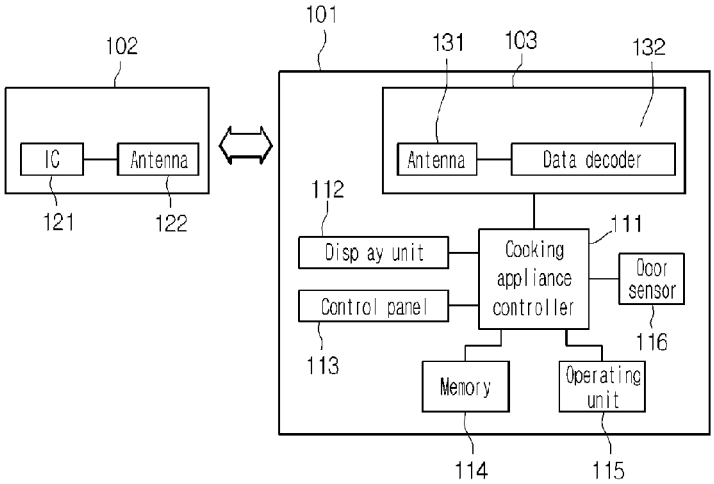
FIG. 7 is a block diagram illustrating a cooking appliance according to the second embodiment.

FIG. 7 is a block diagram illustrating a cooking appliance according to the second embodiment.

Referring to FIG. 7, the cooking appliance 101 includes a RF reader 103 and a plurality of parts for performing general operations of the cooking appliance.

The RF reader 103 includes an antenna 131 for radiating radiant energy or receiving information of a RF tag and a data decoder 132 for decoding the received signal through the antenna 131.

In order to perform general operations of the cooking appliance 101, the cooking appliance 101 includes a cooking appliance controller 111 for generally controlling a cooking appliance, a display unit 112 for displaying the operating states of the cooking appliance, a control panel 113 for enabling a user to control the cooking appliance, a memory for storing various information necessary for operating the cooking appliance, an operating unit 115 including a plurality of parts for heating such as a heater, and a door sensor 116 for sensing a close state and an open state of the door 119.

The door sensor 116 may be provides as a micro switch that is disposed at an external wall of a case, which contacts the door 119 when the door 119 closes. Therefore, the door sensor 116 generates a close signal when a door closes or generates an open signal when a door opens. The generated signal is transferred to the cook appliance controller 111. Since widely known various structures can be applied to the cooking appliance, the detailed description of the cooking appliance is omitted.

Meanwhile, a RF tag is further provided with foods. The RF tag 102 is generally attached at a package sheet of a food or at a food itself. The RF tag includes unique information of a food, such as types, amount, characteristics, and processing states of a corresponding food.

The RF tag 102 includes a predetermined integrated chip (IC) 121 and an antenna 122 for recording and transmitting the information. Since the RF tag 102 is generally made of metal or a plurality of materials that can be burned or generate smoke, the food may be damaged if the RF tag 102 is heated. Particularly, if the electromagnetic wave is applied to the RF tag, the RF tag may be on fire due to sparks generated at the RF tag made of metal.

The operation of a cooking appliance for solving the problem will be briefly described, hereinafter.

When the cooking appliance receives the RF tag 102, the RF reader 103 senses the RF tag 102 and transfers the sensing result to the cooking appliance controller 111. Then, the cooking appliance controller 111 determines that the RF tag 102 is in the cavity 118 and performs operations of a warning mode in order to make the cooking appliance not to operate. The operations of the warning mode will be described in later. If the RF tag 102 is not detected, the cooking appliance controller 111 controls the cooking appliance to normally operate.

Hereafter, a method for controlling a cooking appliance according to the second embodiment will be described with reference to the cooking appliance according to the second embodiment.

Figure 8:
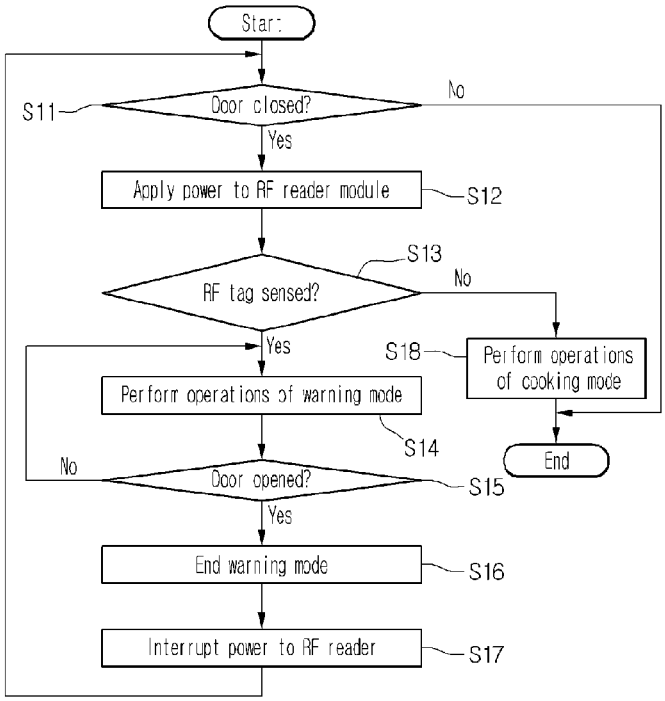
FIG. 8 is a flowchart of a method for controlling a cooking appliance according to the second embodiment.

FIG. 8 is a flowchart illustrating a method for controlling a cooking appliance according to the second embodiment.

Referring to FIG. 8, when a user puts a food in the cavity and closes a door in operation S11, the RF reader is turned on in operation S12. In the operation S11, the door sensor 116 may senses the closing of the door. In the operation S12, the RF reader is turned on after closing the door because the food is not heated with a door open. Also, unnecessary power of the RF reader can be prevent from wasting by turning on the RF reader after closing the door.

After power is applied to the RF reader 103, the RF reader radiates a predetermined radiant energy through the antenna thereof. If the RF tag 102 is in the cavity, the RF tag 102 transmits information stored in the RF tag 102 using the radiant energy of the RF reader as a driving source by the reaction of the radiant energy. Then, the RF reader 103 receives the information from the RF tag 102 and transfers the received information to the cooking appliance controller 111. That is, the RF tag 102 is detected in operation S13.

If the cooking appliance controller 111 detects the RF tag 102 in the cavity as described above, the cooking appliance controller 111 informs a user and performs operations of a warning mode to make the cooking appliance not to operate at the same time in operation S14. If the cooking appliance controller 111 does not receive any information, the normal operations of a cooking mode are performed in operation S18.

Hereinafter, the operations of the warning mode will be described in more detail.

At first, the cooking appliance controller 11 controls the display unit to display a predetermined warning message and warns the user about the RF tag is in the cavity. Then, the cooking appliance controller 11 inactivates keys and buttons of the control panel 113 when a user controls the operation of the cooking appliance through the control panel. Also, the cooking appliance controller 11 controls the operating unit 115 to make various types of heaters not to operate. Occasionally, the cooking appliance controller 11 makes a predetermined warning sound.

Based on the various operations of the warning mode, the user may be aware of the abnormal state of the cooking appliance and recognize that the RF tag 102 is in the cavity through the message displayed on the display unit 112.

The operations of the warning mode are repeatedly performed until the door opens in operation S15. After the user opens the door, the warning mode ends in operation S16. Then, the power applied to the RF reader 103 is interrupted in operation S17.

After interrupting, the user manually finds the RF tag in the cavity and removes the RF tag from the cavity. Then, the user closes the door, and the cooking appliance controller performs the operations of controlling the cooking appliance again.

That is, the cooking appliance does not operate normally until the RF tag is removed from the cavity as described above.

The method for controlling the cooking appliance according to the second embodiment has another implementation as follows.

In another implementation, the RF reader is assembled at the internal wall of the cavity. However, the RF reader may be disposed at the control panel of the cooking appliance in another implementation. In this case, the cooking appliance identifies foods and the identifying result is used to operate the cooking appliance.

In still another implementation, a RF reader may be disposed at the outside of the cavity. In this case, a predetermined radio frequency path is provided to transfer the radiant energy of the RF reader to the inside of the cavity, and the intensity of a radio frequency must be high.

In yet another implementation, the operating unit may include a magnetron. When the RF reader senses the RF tag, the operation of the magnetron is interrupted, thereby safely protecting a user and preventing the cooking appliance from being damaged.

As described above, the method for controlling a cooking appliance according to the second embodiment can prevent the foods from being damaged and from being on fire and can safely control the cooking appliance.

<Third Exemplary Embodiment>

In the first and second embodiments, a cooking appliance performs predetermined operations for cooking foods based on information stored therein or performs operations for safely operating the cooking appliance or protecting a user. In the third exemplary embodiment, a cooking appliance controlling system and method for safely and accurately cooking foods are introduced.

Figures 9, 10:
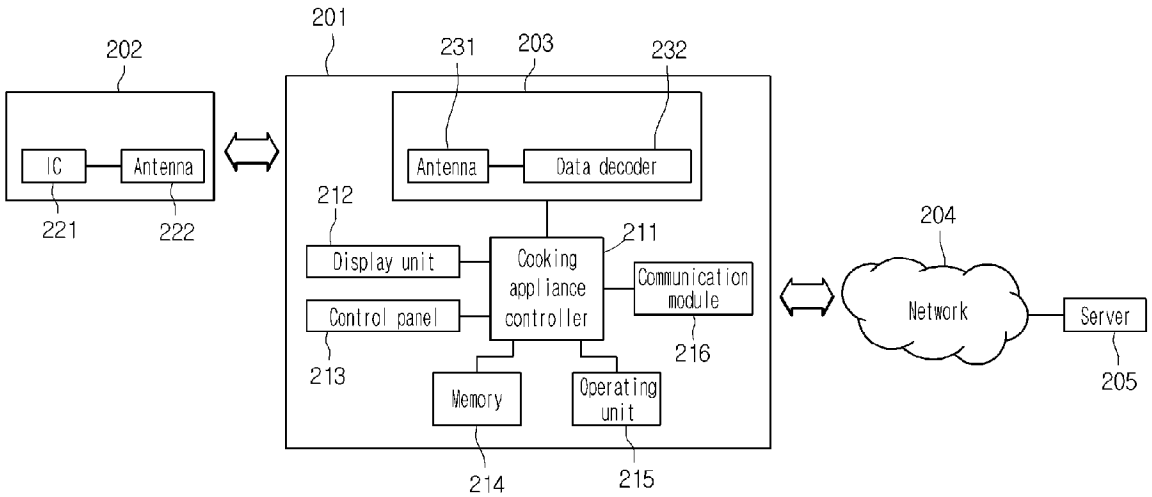
FIG. 9 is a diagram illustrating a system for controlling a cooking appliance according to the third embodiment.
FIG. 10 is a diagram illustrating a information table stored in a RF tag and transmitted to a cooking appliance.

FIG. 9 is a diagram illustrating a system for controlling a cooking appliance according to the third embodiment.

Referring to FIG. 9, the cooking appliance controlling system according to the third embodiment includes a RF tag 202 storing unique information about a corresponding food, a cooking appliance 201 having a RF reader module 203 for reading food related information recorded in the RF tag 202, a server 205 for receiving the food related information from the cooking appliance 201 and processing response information, and a network 204 connecting the server 205 and the cooking appliance 202.

The RF tag 202 includes an integrated chip (IC) 221 storing unique information related to a food and an antenna 222 for transmitting the unique information in radio frequency. The cooking appliance 201 includes a plurality of constituent elements for performing generation operations by interworking with the RF reader module 203. That is, the cooking appliance 201 includes a display unit 212 for displaying the operating states of the cooking appliance, a control panel 213 for enabling a user to control the operations of the cooking appliance, a memory 214 for storing various necessary information to operate the cooking appliance, an operating unit 215 for performing a heating operation of a cooking appliance with a heating source provided, and a cooking appliance controller 211 for controlling general control states of the cooking appliance. The cooking appliance further includes a communication module 216 for communicating with the server 205 through the network 204.

The RF reader module 23 includes an antenna 231 for exchanging a RF signal with the RF tag module 202 and a data decoder 232 for processing information received through the antenna 231.

The communication module 216 accesses the server 205 through the network 204 and exchanges data with the server 205. The server 205 may be a server that is operated by a manufacturer of a food provided with the RF tag 202. The network 204 may be connected to a wireless Internet, a wired Internet, or a home network.

Hereinafter, the operations of the cooking appliance controlling system according to the third embodiment will be described.

At first, a user puts the RF tag 202 attached at the package sheet of a food closer to the cooking appliance 201, that is, the RF reader module 203 when the user wants to cook the food. Then, the information stored in the RF tag 202 is transmitted to the RF reader module 203.

The information stored in the RF tag and transmitted to the cooking appliance is exemplary shown in FIG. 10.

Referring to FIG. 10, the information includes a start code for indicating the start of data and an end code for indicating the end of data. The information further includes an authentication code for authenticating an authentication code of the cooking appliance 201 and for authenticating the RF tag 202 at the server 205. Also, an error field includes a code verifying whether or not an error is generated when data is transmitted. The above described fields are essential codes for operating a RF tag reading system. Such fields may vary according to the detail condition thereof.

In the present embodiment, the RF tag further stores food hierarchical information, the address of a server in a network, and the unique ID of a food.

The food hierarchical information is information for classifying a plurality of food products provided by the manufacturer of a corresponding food product. For example, if a food product is an instant boiled dumpling, the food product has the food hierarchical information such as a semi-finished frozen food instant food/dumpling/instant boiled dumpling. The unique ID of the food product may be a unique name that represents a corresponding food product such as [instant boiled dumpling] or a combination of numerals and alphabets such as a predetermined serial number [12345678] for a server to conveniently recognize the unique name thereof. The food hierarchical information and the unique ID can be conveniently used for the server to search a predetermined food product.

The address of the server 205 in the network may be an IP address on the Internet. The server 205 is a server of a food product company that provides a corresponding food product. The server 205 may provide additional services to a purchaser of a corresponding food product. Here, the network 204 means a wired/wireless network. A wired network may be the Internet network. Furthermore, the address of the server may be an address of a home network. In this case, it may be connected to a server installed at home.

Referring to FIG. 9 again, the information transferred to the RF reader module 203 is stored in the memory 214 and displayed on the display unit 212 in response to the control of the cooking appliance controller 211. A user modifies information about the current state of a food to cook based on the information displayed on the display unit 212. For example, a user modifies the information about the amount of foods, the states of foods, and the position of foods through the control panel 213. In case of an instant boiled dumpling, a user modifies the information about the current state of the instant boiled dumpling as follows. That is, the amount of the instant boiled dumpling is a half of one pack, the instant boiled dumplings are about soaked in the water, and the instant boiled dumplings are putted on a dish. As described above, a user may modify the information about the current state of foods while selecting information stored in the RF tag 202.

After modifying the information about the current state of food, the communication module 216 transfers the modified information to the server 205 through the network 204. The server 205 may be a server provided by the manufacturer of a corresponding food product as described above.

Based on the information about the current state of the food, which is transferred to the server 205, the cooking appliance controller 211 generates a cooking method for cooking the foods with optimal condition according to the current state of the food as predetermined control data. The control date is transmitted to the cooking appliance 201 through the network 204 again. The transferred information is displayed through the display unit 212. Also, a method of operating a cooking appliance to cook the current food with optimal condition is stored in the memory 214. In order to generate the control data by the server 205, the specification of the cooking appliance 201 may be transmitted to the server 205.

Then, a user puts the food in the cooking appliance, and the cooking appliance operates according to the control data.

The cooking appliance control system according to the present implementation cooks the food with the best condition to eat by a user.

Figure 11:
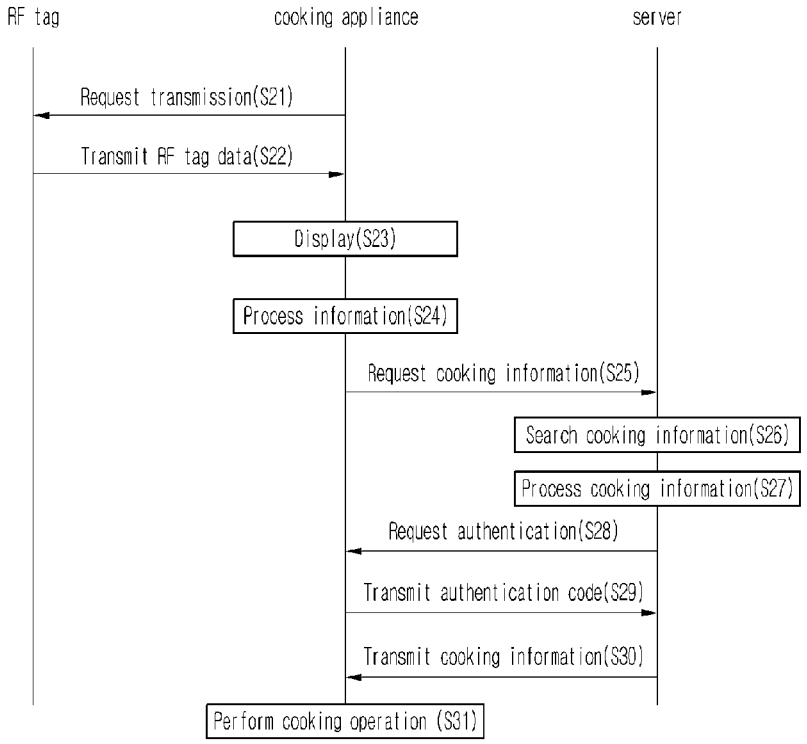
FIG. 11 is a flowchart of a method for controlling a cooking appliance according to the third embodiment.

FIG. 11 is a flowchart illustrating a method for controlling a cooking appliance according to the third embodiment.

Referring to FIG. 11, when a user obtains a cooking method for cooking a semi-finished food product, a user puts a RF tag attached at a package paper of a predetermined food product closer to the cooking appliance. Then, the cooking appliance 201 requests the RF tag 202 to transmit information stored in the RF tag in operation S21. Here, if the RF tag 202 operates in a passive mode, energy may be transmitted to the RF tag 202.

After requesting, the information stored in the RF tag 202 is transmitted to the cooking appliance 201 in operation S22. Before transmitting the information, an authentication procedure for the cooking appliance 201 may be performed. The data is transmitted only if the cooking appliance 201 is authenticated.

The cooking appliance 201 receives data from the RF tag and displays the unique information of a food in operation S23. Here, the displayed information includes a unique ID of a food such as [instant boiled dumpling], food hierarchy information, and an address of a server in a network. The user processes the displayed information in operation S24 and requests the cooking information to the server 205 in operation S25. In the operation S24, the information may be processed based on a protocol defined between the server 205 and the cooking appliance 201. For example, the server 205 and the cooking appliance 201 may previously defines a protocol that the food hierarchy information is inserted into a predetermined transmission field and transmitted to the server 205. Also, information about the amount of a food, the state of a food, and the position of a food are previously stored in the RF tag 202, and predetermined one of stored information is selected by a user. Furthermore, the specification of the cooking appliance 201 may be transmitted although the user may not recognize.

After receiving the request, the server 205 searches detail cooking information corresponding to the identified food from an internal memory. Then, the server 205 collates the searched information with data of an external system in operation S26. Then, the server 205 processes the collated data to transmittable data in operation S27. Here, the processed information may include control data for the cooking appliance 201 as described above. For example, the control data of a cooking appliance suitable for the current state of the food may be that a light wave heater is turned on for 10 minutes at 200 watt.

Before providing food information to the cooking appliance 201, the server 205 requests authentication information for determining whether the cooking appliance 201 is authenticated or not in operation S28. Then, the terminal receiving authentication information transmits an authentication code in operation S29. The authentication code may be information received from the RF tag 202.

After receiving the authentication code and authenticating the authentication code, the processed cooking information is transmitted to the cooking appliance in operation S30.

The transmitted control data is stored in the memory 214 of the cooking appliance 201, and the cooking appliance is driven according to the control data in operation S31.

The method for controlling a cooking appliance according to the third embodiment may have another implementation.

In the method according to the third embodiment, the order of performing the operations S26 to S30 may change. That is, the operation S26 for requesting the food information or the operation S30 for transmitting cooking information may be performed after the operation S28 for requesting the authentication.

As described above, the method for controlling a cooking appliance according to the third embodiment provides the user with the optimal cooking method for foods that the user has. Also, it is not required to a user to watch the foods while the cooking appliance cooks the foods due to the high reliability thereof. Furthermore, it is possible to cook the foods with the optimal taste and the optimal condition according to the specification of the cooking appliance.

It is preferable to use the method for controlling a cooking appliance according to the third embodiment for an instant food which is a frozen food that would be ready to eat after heating the instant food for a predetermined time.

<Fourth Exemplary Embodiment>

In the third embodiment, the optimal method for cooking foods according to the current state of foods was introduced. However, a cooking appliance may not cook foods properly due to the superannuation of the cooking appliance. Such a problem becomes more serious if a food requires a short cooking time to eat.

A system and method for controlling a cooking appliance according to the fourth embodiment provide a further optimal cooking method to a user in consideration of such a problem.

Figure 12:
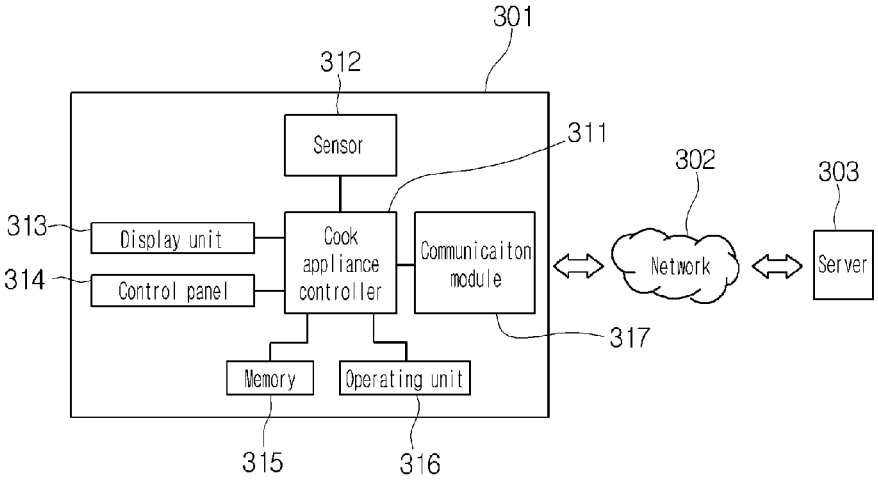
FIG. 12 is a block diagram illustrating a system for controlling a cooking appliance according to the fourth embodiment.

FIG. 12 is a block diagram illustrating a system for controlling a cooking appliance according to the fourth embodiment.

Referring to FIG. 12, the system according to the fourth embodiment includes a cooking appliance 301, a server 303 for receiving the operating states of the cooking appliance 301 and transmitting calibration control information, and a network 302 for connecting the cooking appliance 301 and the server 303.

That is, the cooking appliance 301 includes a cooking appliance controller 311 for controlling the overall operations of the cooking appliance, a display unit 313 for displaying the operating state of the cooking appliance, a control panel 314 for enabling a user to control the cooking appliance, a memory 315 for storing current control information for driving the cooking appliance, and an operating unit 316 including heaters which are controlled directly by the cooking appliance controller 311.

Furthermore, the cooking appliance 301 includes a sensor 312 for sensing current operating states of the cooking appliance and a communication module 317 for transmitting the current operating states to the server or receiving calibration control information from the server.

The sensor 312 can sense diverse information such as temperature, humidity, and smoke. The memory may further store target operating state information as the current control information. The target operating state is an ideal operating state obtained when the cooking appliance 301, that is, the operating unit 316, optimally operates. The memory may further store the specification of the cooking appliance to enable the server to identify the specification of the cooking appliance 301.

The network may be one of a wired, a wireless, and a home network. In general, the network may be the Internet network.

A calibration method will be briefly described with reference to the block diagram of FIG. 12. At first, a user selects a predetermined operating mode by controlling the control panel 314. For example, the user selects a dumpling heat-up mode as an example.

When the dumpling heat-up mode is selected, the cooking appliance controller 311 recognizes the selected dumpling heat-up mode, reads current control information suitable to heat-up the dumpling, and drives the operating unit 316 according to the current control information. After driving the operating unit 316, the sensor 312 senses the states of the cooking appliance, for example, temperature, humidity, and smoke, and stores the sensed states in the memory 315 as actual state information.

The communication module 317 transmits actual state information to the server 303. The server 303 senses the abnormal operation state of the operating unit 315 by comparing the actual state information with the target state information and generates calibration control information. The calibration control information is information for optimally cooking the dumpling in the dumpling heat-up mode based on the operation of the cooking appliance in current states.

The server 303 transmits the calibration control information to the cooking appliance 301 again and the cooking appliance 301 stores the calibration control information as current control information. That is, the cooking appliance 301 removes the current control information stored in the memory and stores the received calibration control information as new current control information. Therefore, if a user performs a dumpling heat-up mode again, the cooking appliance performs cooking operations according to the calibration control information, thereby cooking the dumpling properly.

Figure 13:
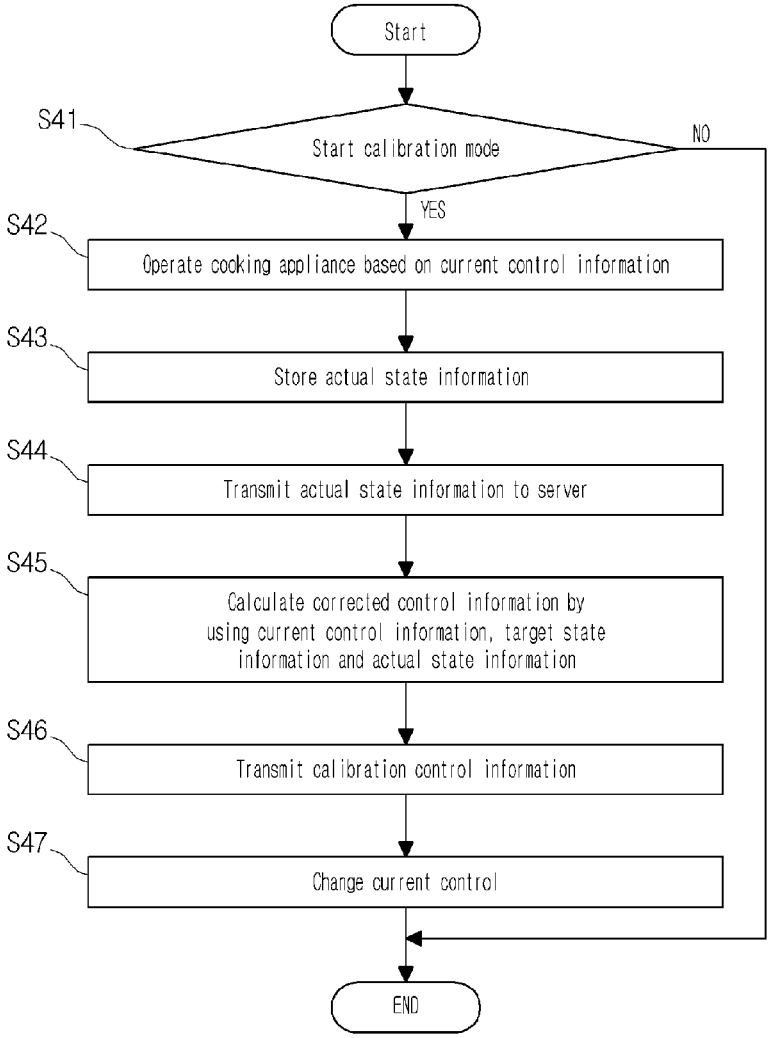
FIG. 13 is a flowchart of a method for controlling a cooking appliance according to the fourth embodiment.
Figure 14:
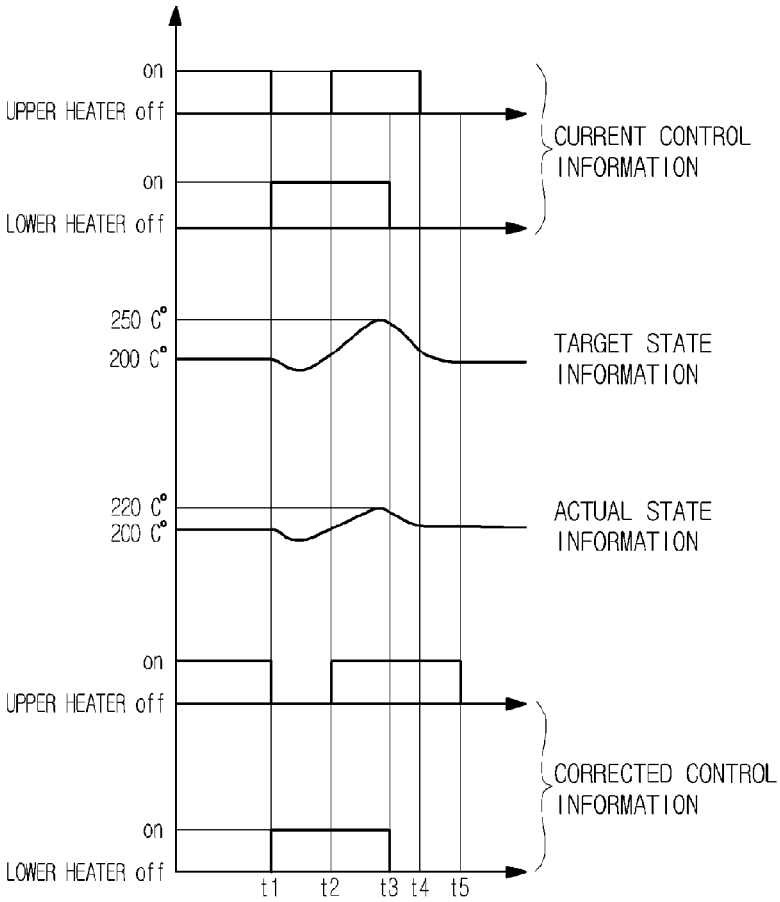
FIG. 14 is a diagram illustrating current control information, target state information, actual state information, and calibration control information.

FIG. 13 is a flowchart illustrating a method for controlling a cooking appliance according to the fourth embodiment, and FIG. 14 is a diagram illustrating current control information, target state information, actual state information, and calibration control information.

The method for controlling a cooking appliance according to the fourth embodiment will be described with reference to FIGS. 13 and 14.

At first, a user determines whether it is required to start a calibration mode or not in operation S41. For example, the calibration mode may start if a user activates a calibration button when the user selects a dumpling heat-up mode using the control panel 314.

After starting the calibration mode, the cooking appliance operates using the current control information in operation S42. Here, the current state of the cooking appliance that operates according to the current control information is stored as the actual state information in operation S43. Then, the stored actual state information is transmitted to the server with the current control information and the target state information in operation S44. The server generates the calibration control information for optimally heating up the dumpling with reference to the transmitted information in operation S45.

A procedure of generating the calibration control information will be described with reference to FIG. 14 in detail. When a user performs the dumpling heat-up mode, the cooking appliance preheats the dumpling by heating an upper heater for a predetermined time t1 and turns on a lower heater for a predetermined time t1 to t3 according to the current control information. Meanwhile, the upper heater may be turned on for a predetermined t2 to t4 again in the dumpling heat-up mode in order to slightly dry the upper surface of the dumpling by increasing the heating level of the upper heater.

As shown in FIG. 14, the temperature of a cavity increases up to 250 degree to dry the surface of the dumpling at predetermined level in the target state information. Here, it is assumed that a temperature sensor is disposed at an upper part of the cavity.

However, the temperature may not increase up to 250 degree due to the super-annuation of the heater. For example, the temperature increases to 220 degree in the actual state information. In this case, the server 303 generates calibration control information with reference to the current control information, the target state information, and the actual state information. According to the generated calibration control information, the upper heater is turned on for longer time t2 to t5 because the temperature cannot be reached to the target temperature. If it allows, the output level of the upper heater is controlled.

Then, the calibration control information makes the actual state information similar or identical to the target state information.

After generating the calibration control information, the calibration control information is transmitted to the cooking appliance in operation S46, and the transmitted calibration control information is stored as new current control information in operation S47. Then, the cooking appliance will heat up the dumpling based on the calibrated current control information in a dumpling heat-up mode.

In the fourth embodiment, it was described that the current control information is generated as single set and transmitted to the server. However, a procedure of generating and transmitting calibration control information is not limited thereto. For example, the current control information may be transmitted to the server in real time, and the server may transmit the calibration control information in real time with reference to the current control information.

<Fifth Exemplary Embodiment>

In the fifth exemplary embodiment, the cooking appliance generates the actual state information identically to the fourth exemplary embodiment. However, the target state information and the current control information are not transmitted in the fifth embodiment. Therefore, the fifth embodiment will be described based on the difference from the fourth embodiment.

In operation S44 for transmitting information from the cooking appliance to the server, the server receives the actual state information, the specification information of the cooking appliance, and a current cooking mode, for example, a dumpling heat-up mode. Then, the server calculates the target state information and the current control information with reference to the actual state information, the specification information of the cooking appliance, and the current cooking mode and generates the calibration control information by comparing the actual state information with the calculated target state information and current control information.

Since the other operations are identical to those of the fourth embodiment, the detailed descriptions are omitted.

<Sixth Exemplary Embodiment>

The sixth exemplary embodiment is very similar to the fourth exemplary embodiment. However, in the sixth exemplary embodiment, a predetermined terminal generates calibration control information instead of transmitting the actual state information generated in the cooking appliance to the server and generating the calibration control information at the server. The sixth embodiment will be described based on the difference from the fourth embodiment.

Figure 15:
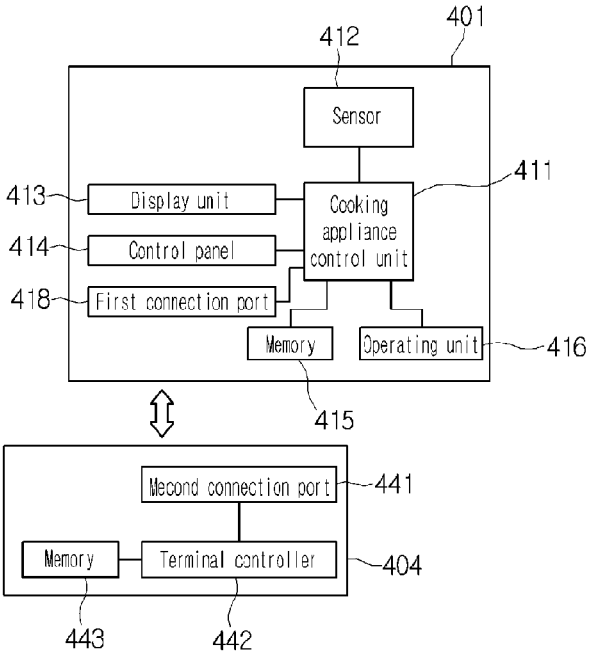
FIG. 15 is a block diagram illustrating a system for controlling a cooking appliance according to the sixth embodiment.
Figure 16:
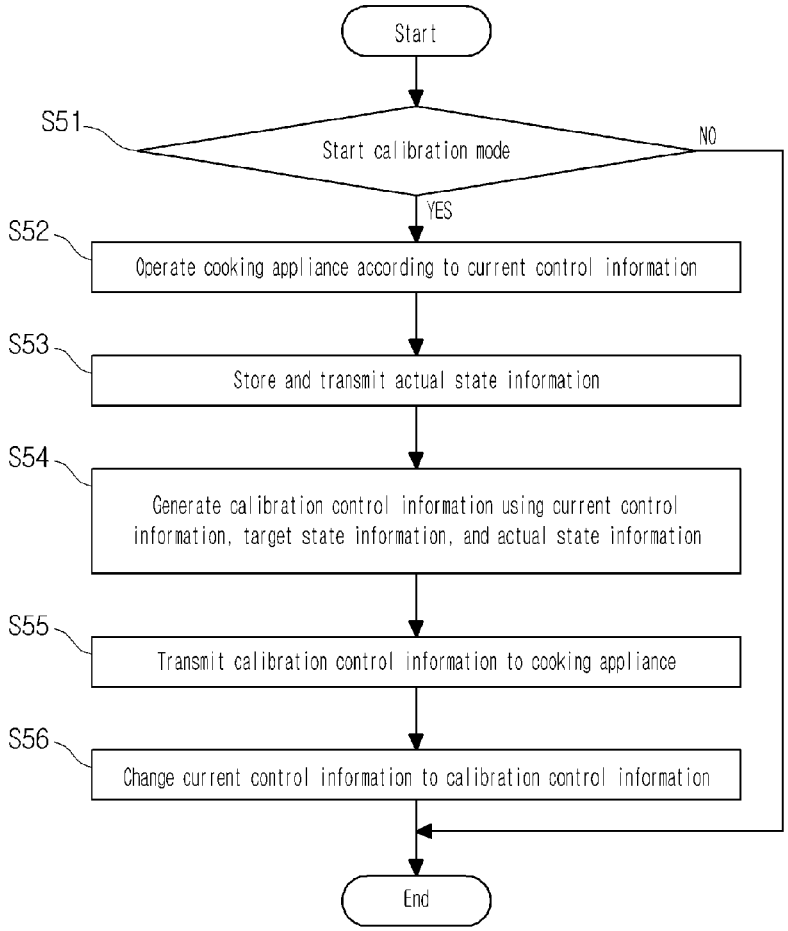
FIG. 16 is a flowchart of a method for controlling a cooking appliance according to the sixth embodiment

FIG. 15 is a system for controlling a cooking appliance according to the sixth embodiment, and FIG. 16 is a method for controlling a cooking appliance according to the sixth embodiment.

Referring to FIGS. 15 and 16, a cooking appliance 401 includes a first connection port 418 instead of the communication module 317, the network 302, and the server 303 of the system according to the third embodiment. A terminal 404 connected to the first connection port 418 includes a second connection port 441 directly connected to the first connection port 418 through a predetermined wire, a terminal controller 442 for controlling the terminal 404, and a memory 443 for storing information to generate the calibration control information.

The actual state information sensed at the cooking appliance 401 is transmitted to the terminal 404 in operations S51, S52, and S53. The terminal 404 generates the calibration control information and transmits the generated calibration control information to the cooking appliance 401 in operations S54 and S55, and updates the current control information of the cooking appliance in operation S56. In this way, the control information is calibrated without using the network 302 like the fourth embodiment. Therefore, the cooking appliance may further stably perform operations for cooking a predetermined food.

The system and method according to the sixth embodiment may be preferably applied when a service man visits home to calibrate the control information. In this case, it is preferable that a user stores the actual state information previously.

In the sixth embodiment, the terminal may calculates the target state information and the current control information with reference to the specification information of the cooking appliance and the current cooking mode and generate the calibration control information based on the actual state information.

The fourth, fifth, and sixth embodiments may further include another implementation as follows.

In fourth, fifth, and sixth embodiments, it was described that the calibration control information is generated at the server and the terminal. However, the scope of the present invention is not limited thereto. For example, a cooking appliance may perform calibration based on the actual state information if the cooking appliance has the sufficient processing power of a controller and the enough storage capacity of a memory.

Also, cooking information of a corresponding food may be transmitted to a server with reference to information read from a RF tag introduced in the first and second embodiments, and the cooking information may be processed based on the transmitted information to be suitable to the cooking appliance.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Industrial Applicability

A system and method for controlling a cooking appliance according to this document enable a user to utilize a cooking appliance in various ways using a RF tag reading system. Also, the controlling system and method controls the cooking appliance to accurately cook foods according to a predetermined cooking method and to provide the natural flavor of the foods to a user. Furthermore the controlling system and method controls the cooking appliance to perform the optimal cooking operation according to the specification of the cooking appliance. Moreover, the controlling system and method prevent foods from being damaged or on fire, which may be caused by the wrongful use of a RF tag reading system. The controlling system and method may lead the popularization of the RF tag reading system, and may extend a service life of a cooking appliance by correcting a service life problem caused by the superannuation of a cooking appliance.

The invention claimed is:

1. A cooking appliance comprising:

a cavity;

a door that opens or closes the cavity to receive food;

an RF reader for reading an RF tag of food as integrant of a dish;

a memory for storing dish information about dishes that can be cooked;

a door sensor to sense a closed state or an open state of the door;

a controller for reading dish information from the memory; and a display unit for displaying at least one of the dish information and alarm information to a user, wherein the RF reader is turned on to determine the RF tag when the door sensor senses the closed state of the door, wherein the controller is configured to determine whether the RF reader reads the RF tag of food after sensing the closed state of the door by the door sensor before starting of cooking of the food in the cavity, and wherein, when the RF reader reads the RF tag of food, the controller controls the display unit to display the alarm information to prevent starting of cooking of the food in the cavity and the controller performs operations of a warning mode.

2. The cooking appliance according to claim 1, wherein a control panel of the cooking appliance includes a suggestion button for starting an operation of an RF tag reading system where the RF tag and the RF reader interwork together.

3. The cooking appliance according to claim 1, wherein the dish information includes a cooking method for cooking a predetermined dish using foods in food information stored in the RF tag.

4. The cooking appliance according to claim 1, wherein the cooking appliance is an oven having the cavity, and the RF reader is disposed at an internal side of the cavity.

5. The cooking appliance according to claim 1, wherein the RF reader is disposed at a control panel, the door, or a door handle in the cooking appliance.

6. The cooking appliance according to claim 1, wherein an indicator is disposed at a predetermined exterior location where the RF reader is disposed, and the indicator indicates where the RF reader is disposed.

7. The cooking appliance according to claim 1, further comprising a server connected to the cooking appliance through a network.

8. The cooking appliance according to claim 7, wherein the server receives food information stored in the RF tag and transfers optimal cooking information for the received food information to the cooking appliance.

9. The cooking appliance according to claim 8, wherein specification information of the cooking appliance is transmitted from the cooking appliance to the server.

10. The cooking appliance according to claim 7, wherein the server receives at least actual operating states of the cooking appliance, compares target state information with actual state information, generates calibration control information, and transmits the generated calibration control information to the cooking appliance.

11. The cooking appliance according to claim 1, wherein the alarm information comprises a warning message to inform a user about the RF tag being in the cavity.

12. The cooking appliance according to claim 1, wherein, when the door sensor senses the opened state of the door, the display stops display of the alarm information.

13. A cooking appliance comprising:

a cavity;

a door that opens or closes the cavity to receive food;

an RF reader for reading an RF tag of food as integrant of a dish;

a memory for storing dish information about dishes that can be cooked;

a door sensor to sense a closed state or an open state of the door;

a controller for reading dish information from the memory;

an output device for generating a warning information to a user; and an input device to input a command, wherein the RF reader is turned on to determine the RF tag when the door sensor senses the closed state of the door, wherein the controller is configured to determine whether the RF reader reads the RF tag of food after sensing the closed state of the door by the door sensor, wherein, when the RF reader reads the RF tag of food before starting cooking of the food in the cavity, the controller controls the output device to generate the warning information and inactivates the input device during generating of the warning information, and when the door sensor senses the opened state of the door, the output device stops generating the warning information.

14. The cooking appliance according to claim 13, further comprising a heating device to heat the food in the cavity, wherein controller inactivates the heating device during generating of the warning information.

15. The cooking appliance according to claim 13, wherein the warning information comprises a warning message to inform a user about the RF tag is in the cavity.

16. The cooking appliance according to claim 15, wherein the warning message is displayed on the output device.

17. The cooking appliance according to claim 15, wherein the warning message is a warning sound.

* * * * *